US008460029B1

(12) United States Patent
Chen

(10) Patent No.: US 8,460,029 B1
(45) Date of Patent: Jun. 11, 2013

(54) STACKED MULTI-PORT CONNECTOR

(75) Inventor: Po-Jung Chen, Taoyuan County (TW)

(73) Assignee: U.D. Electronic Corp., Taoyuan County (TW)

( * ) Notice: Subject to any disclaimer, the term of this patent is extended or adjusted under 35 U.S.C. 154(b) by 0 days.

(21) Appl. No.: 13/362,233

(22) Filed: Jan. 31, 2012

(51) Int. Cl.
*H01R 13/60* (2006.01)

(52) U.S. Cl.
USPC ..... 439/540.1

(58) Field of Classification Search
USPC ..... 439/540.1, 541.5, 701, 717, 594, 439/607.23–607.26
See application file for complete search history.

(56) References Cited

U.S. PATENT DOCUMENTS 7,156,699 B1 * 1/2007 Liu ..... 439/607.55
7,611,383 B1 * 11/2009 Huang ..... 439/620.17
2008/0171454 A1 * 7/2008 Liu et al. ..... 439/74
2009/0269977 A1 * 10/2009 Chen et al. ..... 439/540.1
2010/0075544 A1 * 3/2010 Liu et al. ..... 439/701
2010/0130057 A1 * 5/2010 Schluter et al. ..... 439/540.1
2010/0144188 A1 * 6/2010 Allwood ..... 439/404
2011/0081805 A1 * 4/2011 Chen ..... 439/620.09
2011/0097924 A1 * 4/2011 Chen ..... 439/404

* cited by examiner

*Primary Examiner* — Tulsidas C Patel
*Assistant Examiner* — Phuongchi T Nguyen
(74) *Attorney, Agent, or Firm* — Bacon & Thomas, PLLC

(57) ABSTRACT

A stacked multi-port connector includes a holder member defining multiple rows of mating slots at different elevations, and an electrical module, which includes terminal blocks accommodated in the holder member and holding mating terminals in the mating slots, filter modules electrically coupled with the mating terminal and respectively attached to the terminal blocks, plate members respectively attached to the filter modules and holding therein conducting terminals, that are electrically coupled with light-emitting devices of a light-emitting module at the top side of the holder member, and metal shielding members respectively attached to the plate members between the conducting terminals and the circuit boards of the filter modules to protect signal transmission through the mating terminals from electromagnetic interference.

8 Claims, 10 Drawing Sheets

STACKED MULTI-PORT CONNECTOR

BACKGROUND OF THE INVENTION

1. Field of the Invention

The present invention relates to electric connector technology and more particularly, to a stacked multi-port connector, which has metal shielding members respectively attached to plate members between conducting terminals, which are electrically coupled with light-emitting devices of a light-emitting module, and circuit boards of filter modules, protecting signal transmission through the mating terminals from electromagnetic interference and assuring a high level of signal transmission stability.

2. Description of the Related Art

Following fast development of computer technology, desk computers and notebook computers are well developed and widely used in different fields for different applications. It is the market trend to provide computers having high operating speed and small size. Further, network communication technology brings people closer, helping people to gather information about living, learning, working and recreational activities.

Further, to fit the market trend to create computers and electronic products having light, thin, short and small characteristics, electric connectors for computer and electronic product must be small-sized. Further, using electronic connectors in a computer must consider the problem of interfering noises that include internal noises and surrounding electromagnetic waves. Further, a RJ45 connector is for digital communication application. To eliminate signal interference, a network connector may have a filter module built therein. Further, to fit rapid computer executing speed, signal transmission frequency of related integrated circuits on, for example, Ethernet architecture, has been improved from early 10 Mbps or 100 Mbps to existing 1 Gbps or even 10 Gbps. However, increasing the transmission frequency relatively increases the risk of noise interference. This problem will be more serious in stacked multi-port connector.

FIGS. 9 and 10 illustrate a stacked multi-port connector according to the prior art. According to this design, the stacked multi-port connector comprises an electrically insulated holder member A and a filter module B accommodated in an accommodation space A0 in the holder member A. The holder member A defines multiple rows of mating slots A1 arranged at different elevations, and locating grooves A11 respectively and bilaterally disposed at the top side corresponding to each mating slot A1. Further, terminal blocks A2 are accommodated in the accommodation space A0 of the holder member A, holding upper and lower rows of mating terminals A21. The mating terminals A21 have the respective curved front ends respectively positioned in the mating slots A1 of the holder member A, and the respective rear ends respectively bonded to circuit boards B2 at two sides of each of base members B1 of the filter module B. The filter module B further comprises a plurality of conducting terminals B11 respectively connected to the circuit boards B2 and electrically coupled to filter components B21 at the circuit boards B2.

Further, plate members B3 are respectively disposed at two opposite lateral sides relative to the circuit boards B2, each having a plurality of pinholes 831. The stacked multi-port connector further comprises a plurality of light-emitting devices C. The light-emitting devices C are respectively positioned in the locating grooves A11, having pins C1 thereof respectively inserted into the pinholes B31.

According to the aforesaid prior art design, no any metal shielding means is provided between the pins C1 of the light-emitting devices C and the circuit boards B2 for noise protection. During operation of the stacked multi-port connector, the signal of the light-emitting devices C may interfere with the network signal being transmitted through the mating terminals A21, affecting network signal transmission stability. This noise interference problem will become serious when the number of the mating slots A1 and the number of the pins C1 of the light-emitting devices C are increased.

Therefore, there is a strong demand for a stacked multi-port connector, which eliminates the aforesaid noise interference problem.

SUMMARY OF THE INVENTION

The present invention has been accomplished under the circumstances in view. It is therefore the main object of the present invention to provide a stacked multi-port connector, which effectively protects signal transmission from electromagnetic interference, assuring a high level of signal transmission stability.

To achieve this and other objects of the present invention, a stacked multi-port connector comprises a holder member, a light-emitting module mounted at the top side of the holder member, and an electrical module, which comprises terminal blocks holding mating terminals in respective mating slots of the holder member, filter modules electrically coupled with the mating terminals and respectively attached to the terminal blocks, plate members respectively attached to the filter modules and holding therein conducting terminals, that are electrically coupled with light-emitting devices of the light-emitting module, and metal shielding members respectively attached to the plate members between the conducting terminals and the circuit boards of the filter modules to protect signal transmission through the mating terminals from electromagnetic interference, assuring signal transmission stability.

Further, the metal shielding members of the electrical module each comprises a plurality of first pins disposed at the top side thereof and respectively electrically connected to respective connection portions of the light-emitting module, and a plurality of second pins respectively downwardly inserted through respective through holes of a grounding circuit board at the bottom side of the holder member and bonded thereto for discharging noises.

DETAILED DESCRIPTION OF THE PREFERRED EMBODIMENT

Figure 1:
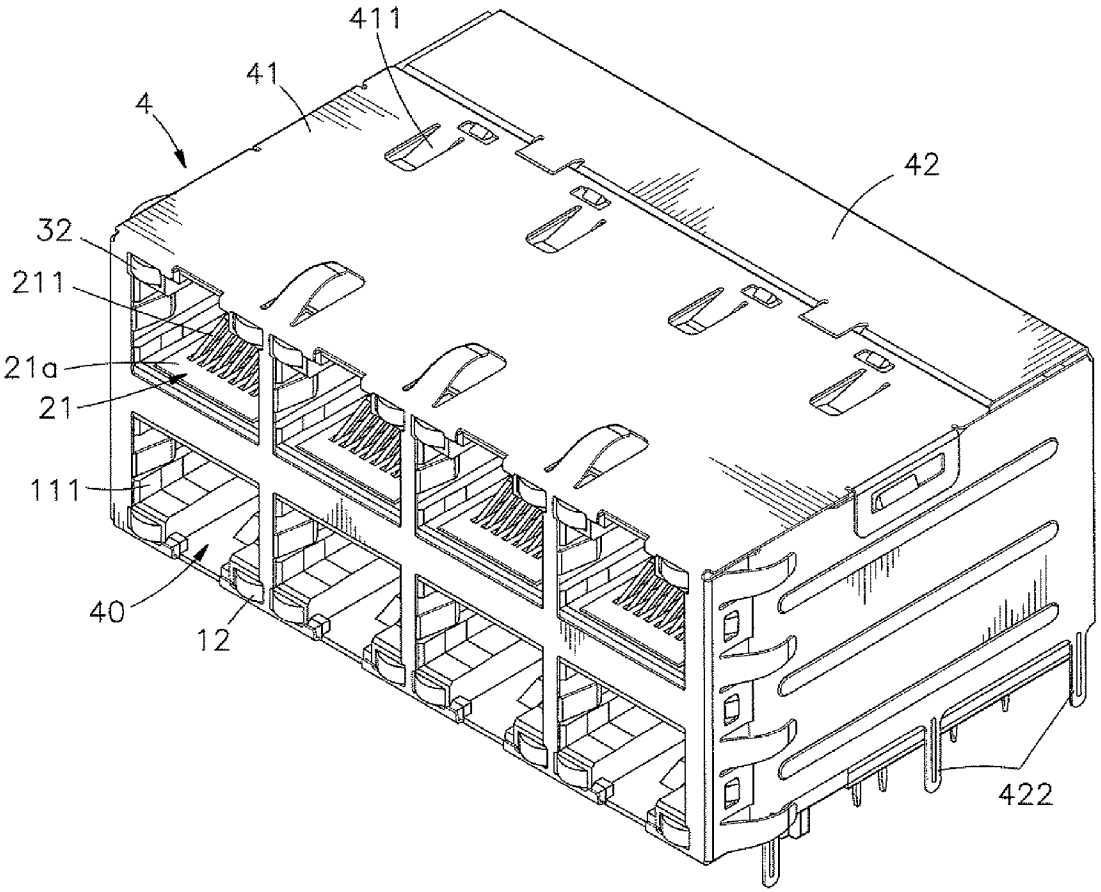
FIG. 1 is an oblique top elevational view of a stacked multi-port connector in accordance with the present invention.

Reference will be made in detail to the preferred embodiment of the invention, an example of which is illustrated in the accompanying drawings. Wherever possible, like reference numbers are used in the drawings and the description to refer to like parts.

Figure 2:
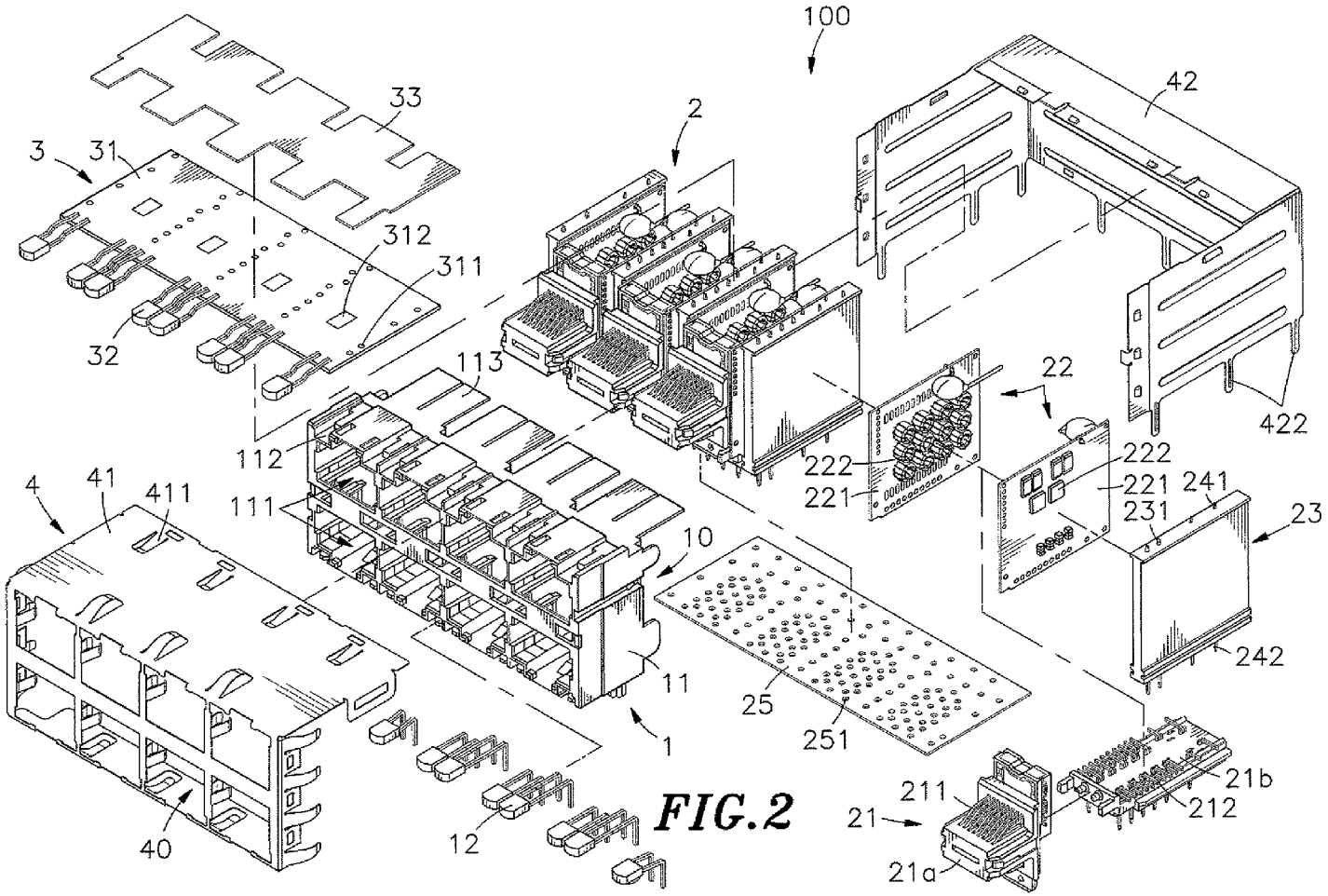
FIG. 2 is an exploded view of the stacked multi-port connector in accordance with the present invention.
Figure 3:
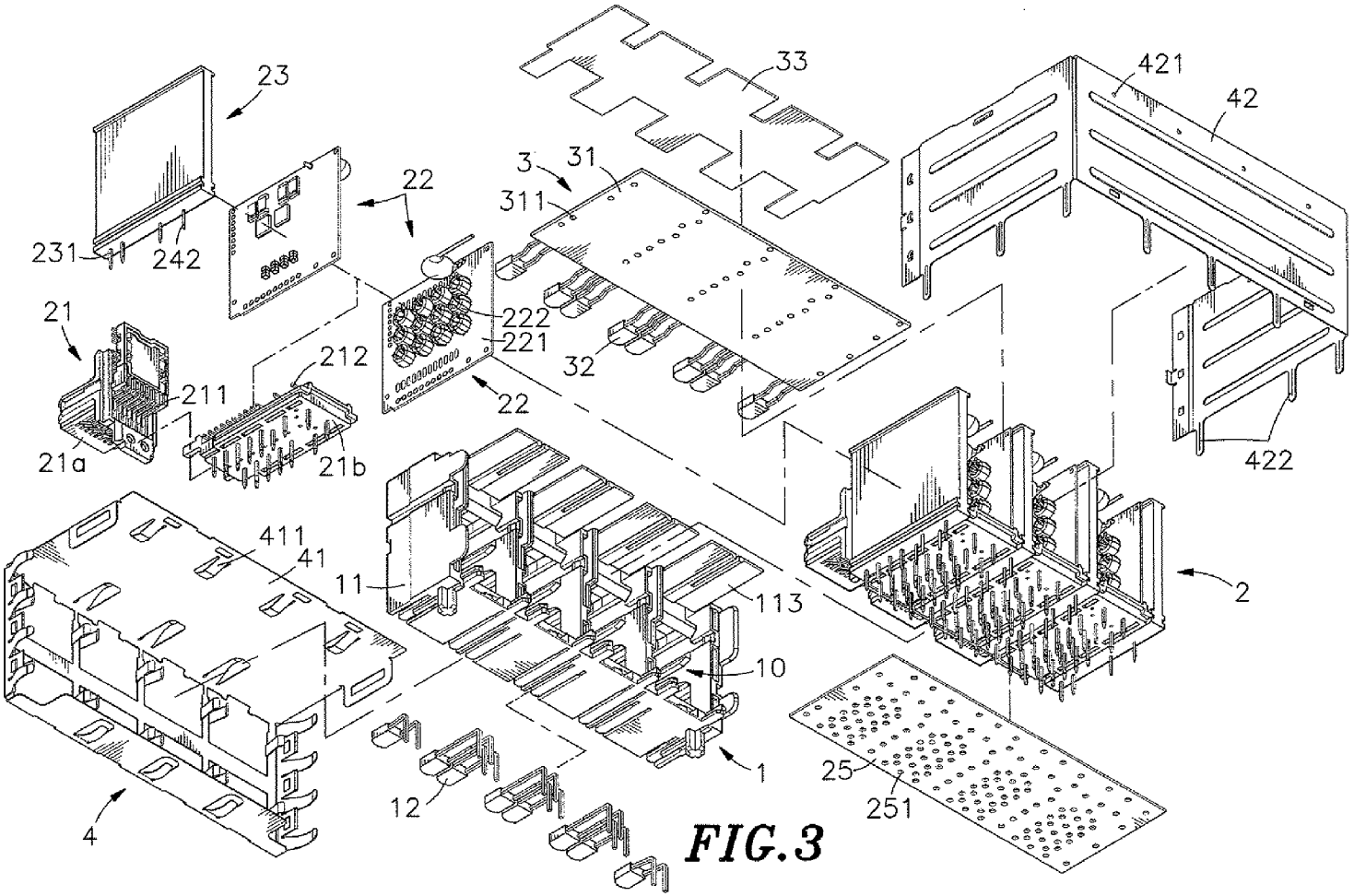
FIG. 3 corresponds to FIG. 2 when viewed from another angle.
Figure 4:
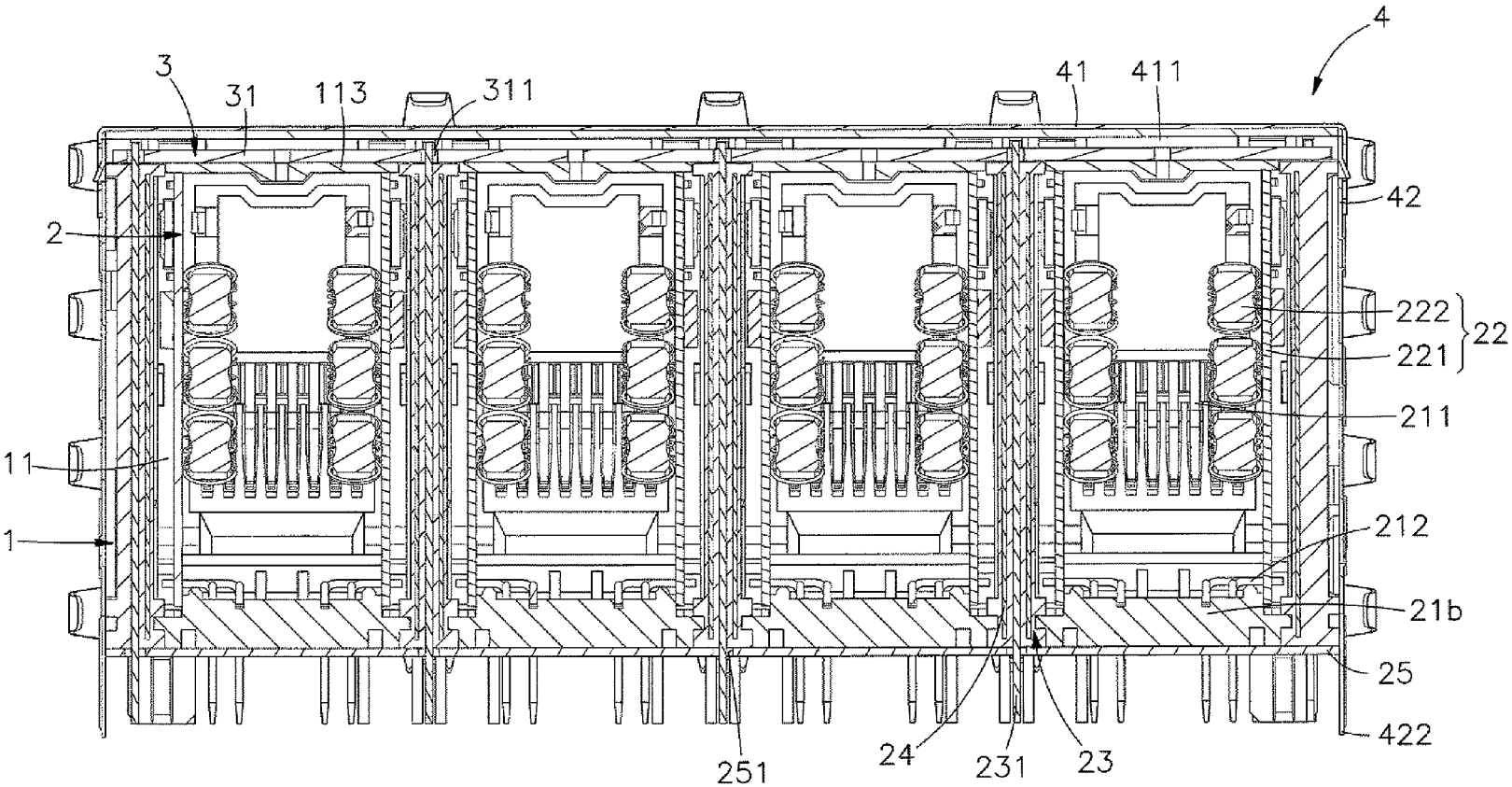
FIG. 4 is a sectional rear side view, in an enlarged scale, of the stacked multi-port connector in accordance with the present invention.

Referring to FIGS. 1, 2, 3 and 4, an elevational view, an exploded view, an exploded view viewed from another angle and a sectional rear side view in an enlarged scale of a stacked multi-port connector 100 in accordance with the present invention are respectively shown. The stacked multi-port connector 100 comprises a holder member 1, an electrical module 2, a light-emitting module 3, and an outer metal shield 4.

The holder member 1 comprises a frame base 11, an accommodation space 10 defined in the frame base 11 for accommodating the electric module 2, multiple rows of mating slots 111 defined in the front side of the frame base 11 at different elevations, a plurality of locating grooves 112 respectively and bilaterally disposed corresponding to each of the mating slots 111 for accommodating light-emitting devices 12 respectively, and a partition plate 113 backwardly extended from the top thereof and suspending above the accommodation space 10.

The electrical module 2 comprises a plurality of terminal blocks 21, a plurality of filter modules 22, which are respectively attached to the terminal blocks 21 and each of which comprises at least one, for example, two circuit boards 221 and a plurality of electronic components 222 with rectifying/filtering function mounted at the circuit board 221, a plurality of plate members 23 respectively attached to the filter modules 22, a plurality of metal shielding members 24 respectively attached to the plate members 23, and a grounding circuit board 25, which is provided at the bottom side relative to the terminal blocks 21, filter modules 22, plate members 23 and metal shielding members 24 and has a plurality of through holes 251. Each terminal block 21 comprises a front block member 21*a* holding upper and lower rows of mating terminals 211, which have a respective curved front end positioned in one mating slot 111 of the frame base 11 of the holder member 1 and a respective rear end connected to the circuit boards 221 of one of the filter modules 22, and a bottom block 21*b* holding a plurality of downwardly extending mounting terminals 212 that extend through respective through holes 251 of the grounding circuit board 25. Each plate member 23 holds therein a plurality of conducting terminals 231 respectively downwardly inserted through respective through holes 251 of the grounding circuit board 25 for boding to an external circuit board. The metal shielding members 24 are respectively set between the circuit boards 221 of the filter modules 22 and the plate members 23 and kept apart from the conducting terminals 231 a predetermined distance, each comprising a plurality of first pins 241 and second pins 242 respectively vertically extended from top and bottom sides thereof. The second pins 242 of the metal shielding members 24 are respectively downwardly inserted through respective through holes 251 of the grounding circuit board 25 for bonding to an external circuit board. Further, the electronic components 222 of the filter modules 22 can be filter components, resistor networks, capacitors, rectifiers or any other devices with rectifying/filtering function.

The light-emitting module 3 comprises a circuit board 31, which is supported on the partition plate 113 of the holder member and comprises a plurality of connection portions 311 and grounding contacts 312, a plurality of light-emitting devices 32 electrically connected to the circuit board 31 and extending out of the front side of the circuit board 31, and a cover plate 33 covering the circuit board 31 over the light-emitting devices 32.

The outer metal shield 4 surrounds the holder member 1, comprising a front shield member 41 and a back shield member 42. The front shield member 41 comprises a plurality of openings 40 corresponding to the mating slots 111 of the frame base 11, and a plurality of grounding spring lugs 411 respectively attached to the grounding contacts 312 of the circuit board 31 of the light-emitting module 3. The back shield member 42 comprises a plurality of connection portions 421 and a plurality of bottom grounding legs 422.

Figure 5:
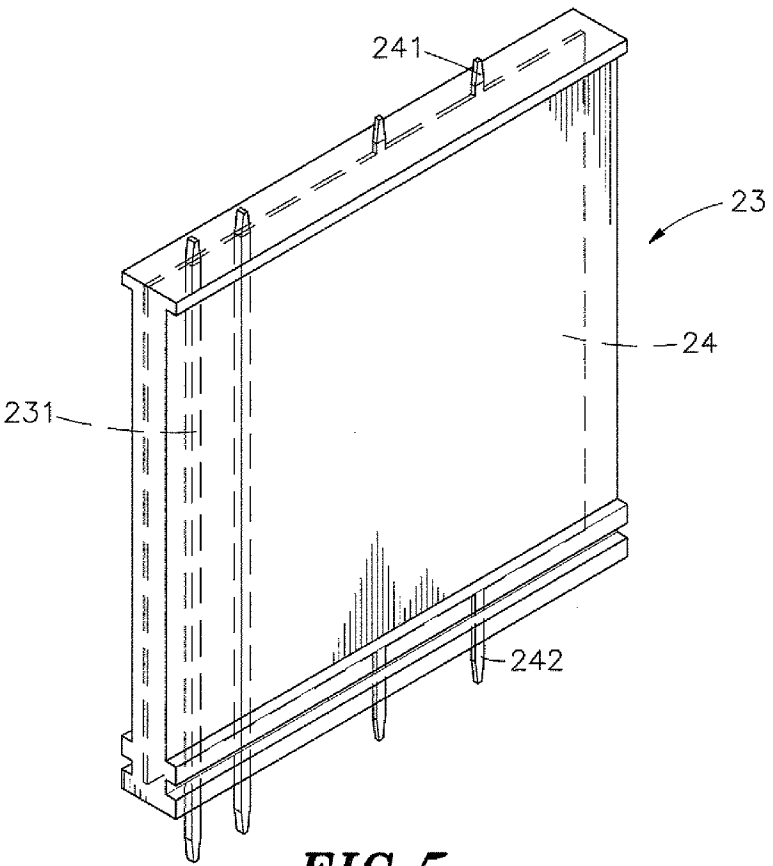
FIG. 5 is a perspective view of a part of the electrical module of the stacked multi-port connector in accordance with the present invention, illustrating the arrangement of the metal shielding members and the plate members.
Figure 6:
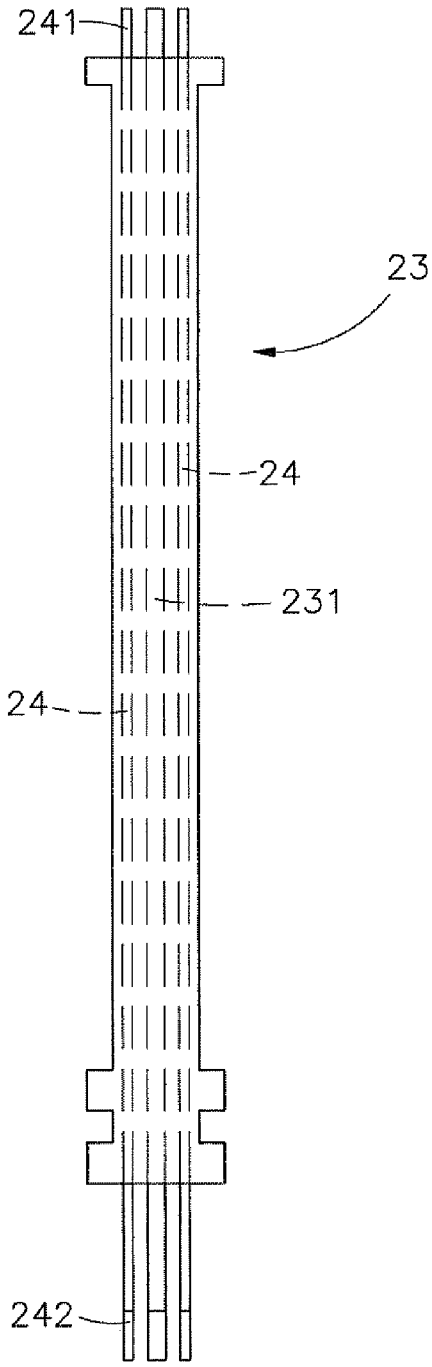
FIG. 6 is a front view of FIG. 5.
Figure 7:
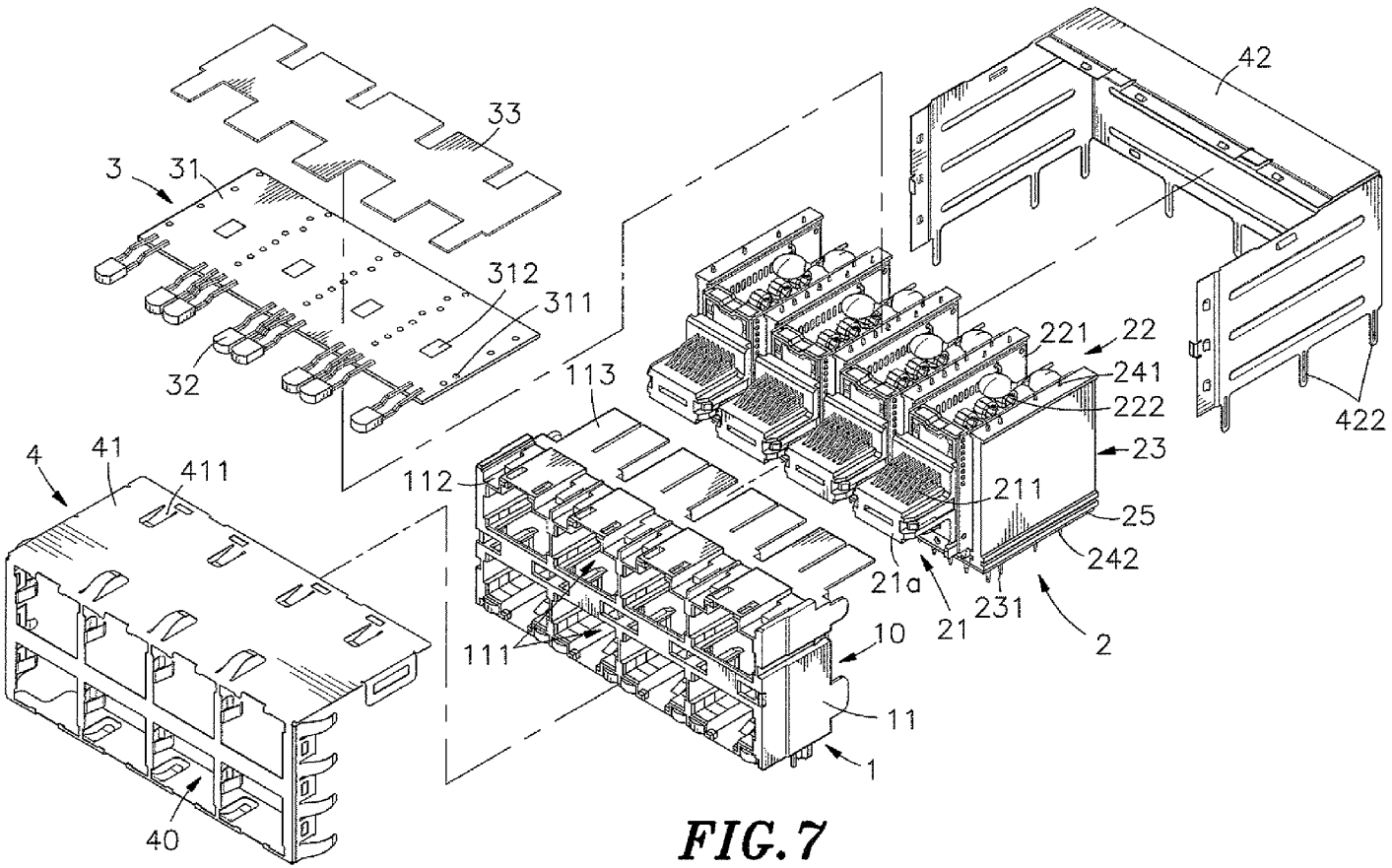
FIG. 7 corresponds to FIG. 2, illustrating the stacked multi-port connector partially assembled.
Figure 8:
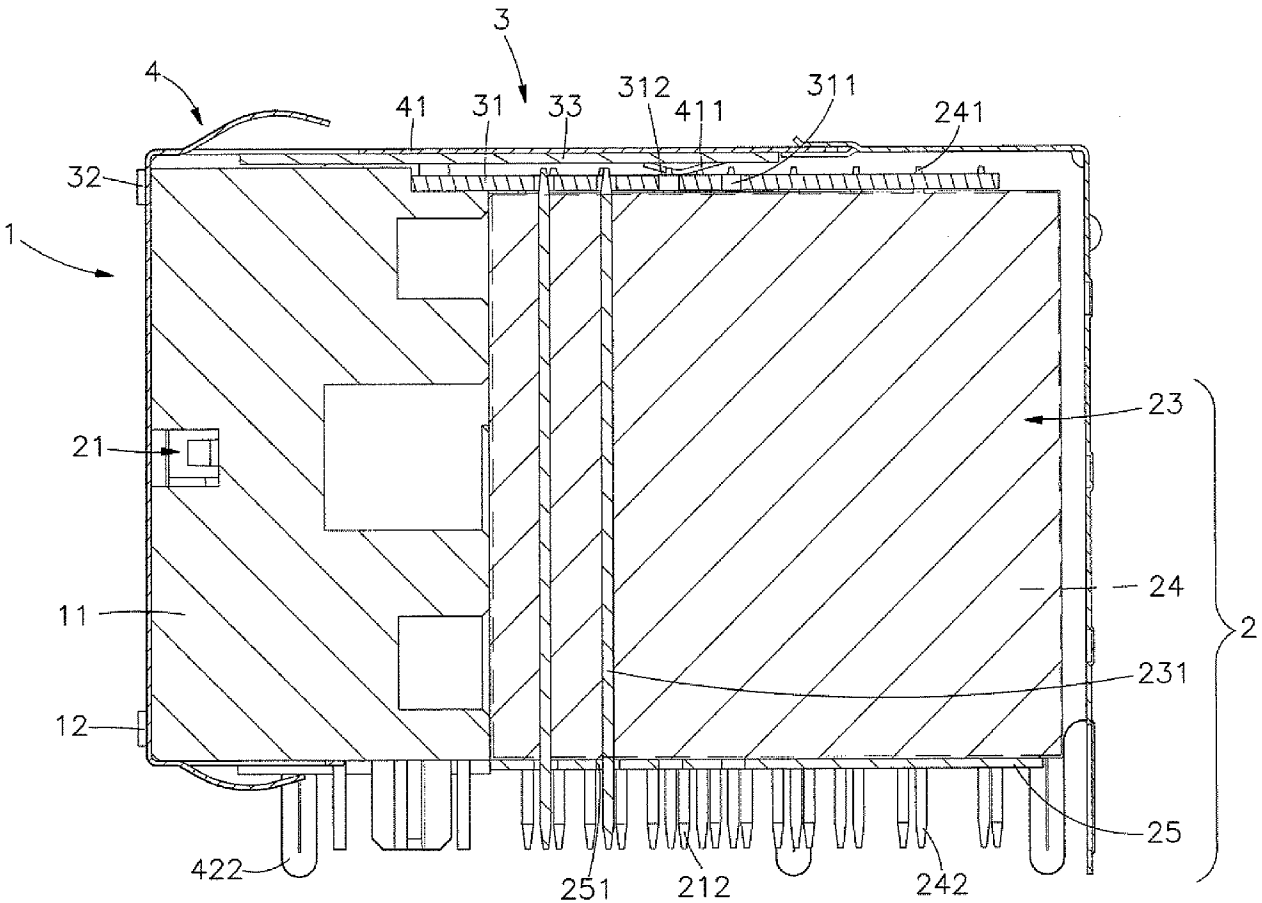
FIG. 8 is a sectional side view of the stacked multi-port connector in accordance with the present invention.
Figure 9:
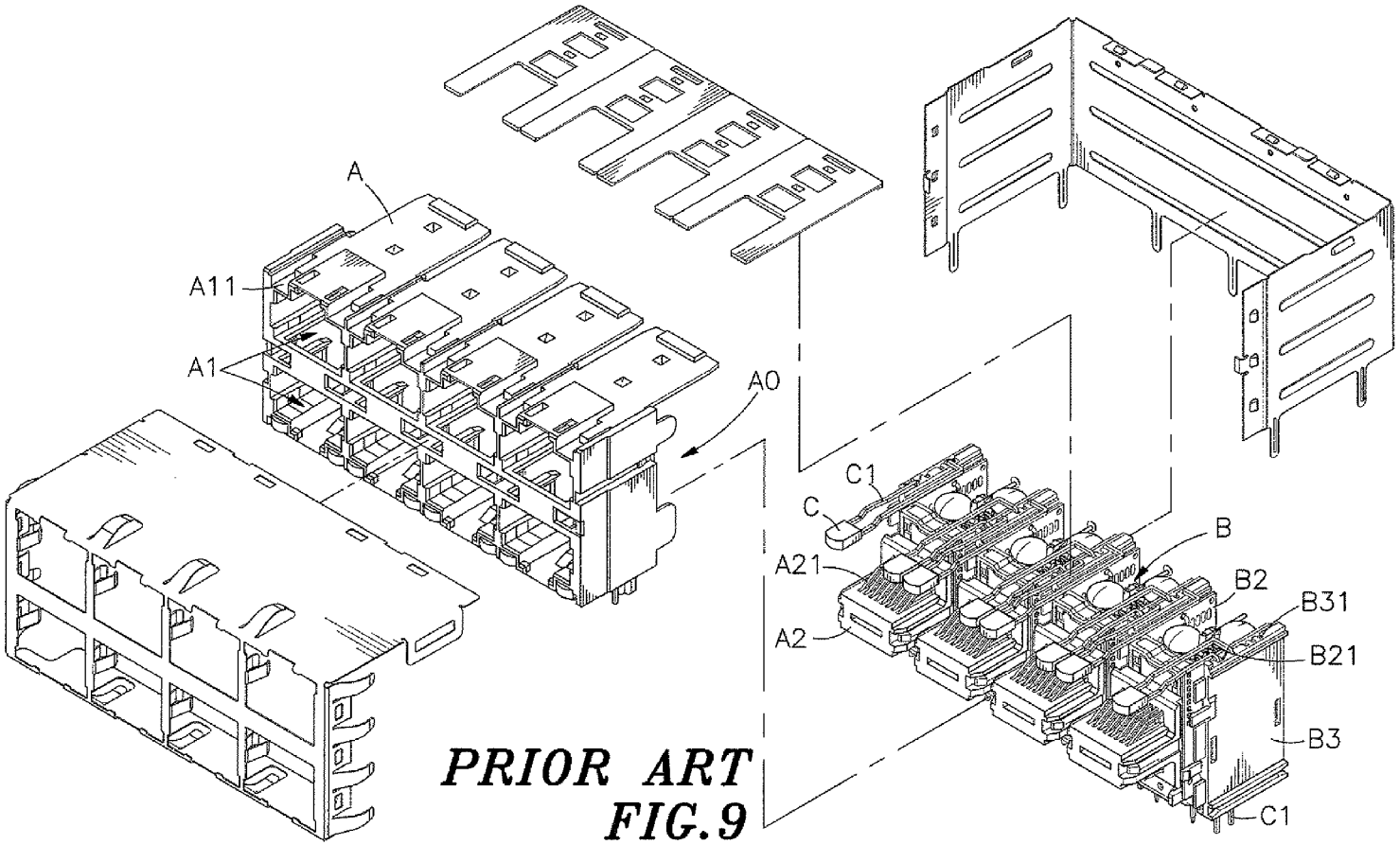
PRIOR ART FIG. 9
FIG. 9 is an exploded view of a stacked multi-port connector according to the prior art.
Figure 10:
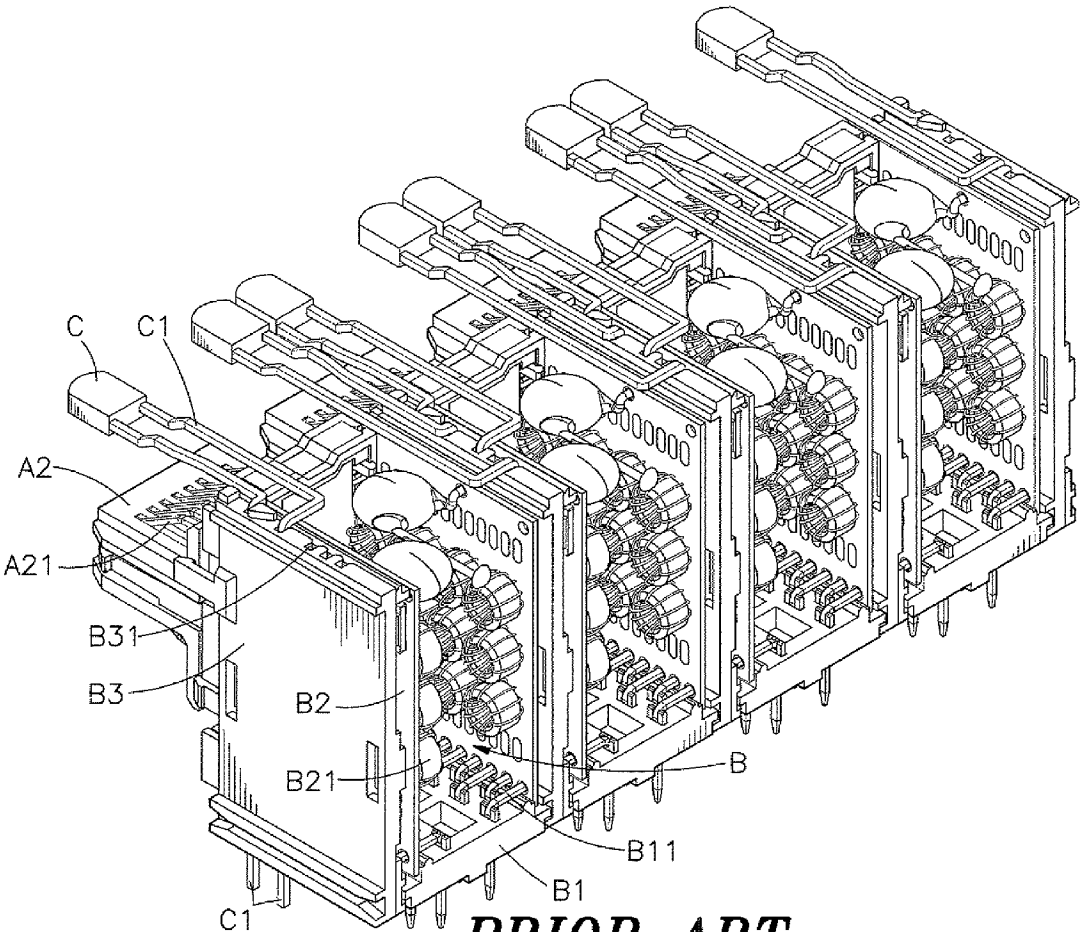
PRIOR ART FIG. 10
FIG. 10 is an elevational view, in an enlarged scale, of a part of the stacked multi-port connector shown in FIG. 9.

The installation of the stacked multi-port connector 100 will now be described hereinafter with reference to FIGS. 5, 6, 7 and 8. Each plate member 23 of the electrical module 2 with the respective conducting terminals 231 and the associating metal shielding member 24 can be made in integrity by means of insert molding. Alternatively, any other suitable fastening or bonding technique may be employed to affix each plate member 23 of the electrical module 2 with the respective conducting terminals 231 and the associating metal shielding member 24 together. Further, each metal shielding member 24 can be a single-sheet, dual-sheet or multi-sheet member positioned in the associating plate member 23 of the electrical module 2. Further, the first pins 241 and second pins 242 of each metal shielding member 24 are respectively extended out of the opposing top and bottom sides of the associating plate member 23 and respectively electrically bonded to the light-emitting module 3 and the electrical module 2.

During installation, the front block members 21*a* of the terminal blocks 21 of the electrical module 2 are respectively vertically fastened to the respective front sides of the respective bottom blocks 21*b*, and then the circuit boards 221 of the filter modules 22 are respectively bilaterally attached to the respective bottom blocks 21*b* of the terminal blocks 21, and then the mounting terminals 212 of the bottom blocks 21*b* are respectively electrically bonded to the circuit boards 221, and then the terminal blocks 21 of the electrical module 2 are accommodated in the accommodation space 10 of the holder member 1 to have the curved front ends of the upper and lower rows of mating terminals 211 be positioned in the mating slots 111 of the frame base 11 of the holder member 1. Further, each plate member 23 of the electrical module 2 can be a double layer design consisting of two flat components respectively installed in the associating terminal block 21 at two sides relative to the circuit boards 221 of the associating filter module 22. Thus, the components of the electrical module 2 can be conveniently accommodated in the accommodation space 10 of the holder member 1 in a horizontally or vertically stacked manner.

Thereafter, the circuit board 31 of the light-emitting module 3 is placed on the partition plate 113 of the holder member 1 to keep the light-emitting devices 32 in the locating grooves 112 of the frame base 11 of the holder member 1 above the mating slots 111, and then electrically connect the top ends of the conducting terminals 231 in the plate members 23 and the first pins 241 of the metal shielding members 24 of the electrical module 2 to the connection portions 311 of the circuit board 31 respectively by means of SMT or through-hole technology. Further, the connection portions 311 of the circuit board 31 can be via holes or contacts. Thereafter, the cover plate 33 is covered on the circuit board 31 over the light-emitting devices 32. Thereafter, the grounding circuit board 25 is attached to the bottom side of the bottom blocks 21*b* of the terminal blocks 21 of the electrical module 2, enabling the bottom ends of the mounting terminals 212 of the terminal blocks 21, the bottom ends of the conducting terminals 231 in the plate members 23 and the second pins 242 of the metal shielding members 24 to be downwardly inserted through the through holes 251 of the grounding circuit board 25 for bonding to an external circuit board.

Thereafter, the front shield member 41 and back shield member 42 of the outer metal shield 4 are attached to the holder member 1 to surround the frame base 11. At this time, the grounding spring lugs 411 of the front shield member 41 are inserted through the cover plate 33 and respectively electrically bonded to the grounding contacts 312 of the circuit board 31 of the light-emitting module 3 with solder paste by, for example, laser welding. Thus, the metal shielding members 24 of the electrical module 2, the grounding contacts 312 of the circuit board 31 of the light-emitting module 3 and the grounding spring lugs 411 of the front shield member 41 of the outer metal shield 4 are electrically connected, forming a grounding loop. Thereafter, the electronic components 222 of the filter modules 22 of the electrical module 2 are respectively electrically bonded to the connection portions 421 of the back shield member 42, and then, the mounting terminals 212 of the terminal blocks 21, the bottom ends of the conducting terminals 231 in the plate members 23, the second pins 242 of the metal shielding members 24 and the bottom grounding legs 422 of the back shield member 42 that are extended out of the bottom side of the holder member 1 are respectively electrically bonded to an external circuit board (not shown).

When external signal is transmitted through the external circuit board to the mounting terminals 212 of the terminal blocks 21, the electronic components 222 of the filter modules 22 of the electrical module 2 remove noises from the input signal, enabling the filtered signal to be transmitted through the mating terminals 211 in the mating slots 111 of the frame base 11 of the holder member 1 to the mating electric connectors of external electronic devices being inserted into the mating slots 111. At this time, the metal shielding members 24 between the conducting terminals 231 in the plate members 23 and the circuit boards 221 of the filter modules 22 provides shielding and isolating effects to effectively eliminate electromagnetic interference. Thus, the input signal is protected from the interference of the signal of the light-emitting module 3; the metal shielding members 24 guide all noises from the area around the electronic components 222 of the filter modules 22 to the grounding loop for discharging, assuring a high level of signal transmission stability.

Referring to FIGS. 2, 4, 6 and 8 again, subject to the arrangement of the electrical module 2 at the top side of the holder member 1 and the arrangement of the conducting terminals 231 in the plate members 23 and the metal shielding members 24 between the conducting terminals 231 in the plate members 23 and the circuit boards 221 of the filter modules 22, the invention provides shielding and isolating effects to effectively eliminate electromagnetic interference, protecting the input signal from the interference of the signal of the light-emitting module 3 and assuring a high level of signal transmission stability.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A stacked multi-port connector, comprising:

a holder member defining multiple rows of mating slots in a front side thereof at different elevations, an electrical module accommodated in said holder member, said electrical module comprising a plurality of mating terminals respectively positioned in said mating slots of said holder member and a plurality of mounting terminals respectively extending out of said holder member for bonding to an external circuit board, and a light-emitting module arranged at a top side of said holder member, wherein said electrical module comprises a plurality of terminal blocks holding said mating terminals, a plurality of filter modules respectively attached to said terminal blocks, each said filter module comprising at least one circuit board and a plurality of electronic components having rectifying/filtering function and electrically coupled with said mating terminals, a plurality of plate members respectively attached to said filter modules and holding therein a plurality of conducting terminals, and a plurality of metal shielding members respectively attached to said plate members and respectively set between said conducting terminals and the circuit boards of said filter modules to protect signal transmission through said mating terminals from electromagnetic interference; said tight-emitting module comprises a circuit board carrying a plurality of light-emitting devices that are respectively electrically connected to said conducting terminals; wherein said electrical module further comprises a grounding circuit board arranged at a bottom side relative to said terminal blocks, said filter modules, said plate members and said metal shielding members, said grounding circuit board comprising a plurality of through holes; each said terminal block comprises a front block member holding said mating terminals and a bottom block holding said mounting terminals that extend through respective through holes of said grounding circuit board; said metal shielding members of said electrical module each comprises a plurality of second pins respectively downwardly inserted through respective through holes of said grounding circuit board for bonding to an external circuit board.

2. The stacked multi-port connector as claimed in claim 1, wherein said holder member comprises a frame base defining therein said mating slots, said frame base comprising a plurality of locating grooves respectively and bilaterally disposed corresponding to each said mating slot; said light-emitting devices of said light-emitting module are respectively positioned in said locating grooves.

3. The stacked multi-port connector as claimed in claim 1, further comprising an outer metal shield surrounding holder member, said outer metal shield comprising a plurality of grounding spring lugs, wherein said light-emitting module further comprises a plurality of grounding contacts located on the circuit board thereof and respectively electrically connected to said grounding spring lugs.

4. The stacked multi-port connector as claimed in claim 1, wherein said electronic components of said filter modules are selected from the group of filter components, resistor networks, capacitors and rectifiers.

5. The stacked multi-port connector as claimed in claim 1, wherein each said plate member of said electrical module is bonded with the respective conducting terminals and the associating metal shielding member by means of insert molding.

6. The stacked multi-port connector as claimed in claim 1, wherein said light-emitting module further comprises a plurality of connection portions located on the circuit board thereof; said metal shielding members of said electrical module each comprises a plurality of first pins disposed at a top side thereof and respectively electrically connected to the respective connection portions of said light-emitting module; said conducting terminals have respective top ends thereof respectively electrically connected to the respective connection portions of said light-emitting module.

7. The stacked multi-port connector as claimed in claim 6, wherein said connection portions of said light-emitting module are contact spots respectively electrically bonded with the top ends of said conducting terminals and said first pins of said metal shielding members by means of SMT.

8. The stacked multi-port connector as claimed in claim 6, wherein said connection portions of said light-emitting module are via holes respectively electrically bonded with the top ends of said conducting terminals and said first pins of said metal shielding members by means of through-hole technology.

* * * * *